US008033399B2

(12) United States Patent
Pistorius et al.

(10) Patent No.: US 8,033,399 B2
(45) Date of Patent: Oct. 11, 2011

(54) CENTRIFUGAL SEPARATOR

(75) Inventors: Thomas Pistorius, Herne (DE); Christian Storm, Duisburg (DE)

(73) Assignee: Babcock Borsig Service GmbH, Oberhausen (DE)

( * ) Notice: Subject to any disclaimer, the term of this patent is extended or adjusted under 35 U.S.C. 154(b) by 127 days.

(21) Appl. No.: 12/442,043

(22) PCT Filed: Aug. 17, 2007

(86) PCT No.: PCT/EP2007/058588
§ 371 (c)(1),
(2), (4) Date: Jun. 11, 2009

(87) PCT Pub. No.: WO2008/034680
PCT Pub. Date: Mar. 27, 2008

(65) Prior Publication Data

US 2009/0294333 A1 Dec. 3, 2009

(30) Foreign Application Priority Data

Sep. 20, 2006 (DE) ..... 10 2006 044 833

(51) Int. Cl.
*B04B 5/12* (2006.01)

(52) U.S. Cl. ..... 209/713; 209/718; 209/208; 209/142; 209/143

(58) Field of Classification Search ..... 209/142, 209/143, 208, 713, 718
See application file for complete search history.

(56) References Cited

U.S. PATENT DOCUMENTS 22,395 A * 12/1858 Woodward ..... 99/601
919,291 A * 4/1909 Moodie ..... 209/139.2
1,367,636 A * 2/1921 Sturtevant ..... 209/139.2
1,384,929 A * 7/1921 Sturtevant ..... 209/139.2
1,385,847 A * 7/1921 Sturtevant ..... 209/139.2
1,457,110 A * 5/1923 Gay ..... 209/139.1
1,470,892 A * 10/1923 Sturtevant ..... 209/139.2
1,517,900 A * 12/1924 Gay ..... 209/148
1,698,361 A * 1/1929 Dreisbach ..... 209/153
1,834,095 A * 12/1931 Fraser ..... 209/139.2
1,958,726 A * 5/1934 Sturtevant ..... 209/139.2
2,030,612 A * 2/1936 Sturtevant ..... 209/139.2
2,109,477 A * 3/1938 Gay ..... 209/139.2
2,109,478 A * 3/1938 Gay ..... 209/139.2
2,188,634 A * 1/1940 Sturtevant ..... 209/139.2
2,206,981 A * 7/1940 Sturtevant ..... 209/139.2
2,269,412 A * 1/1942 Sturtevant ..... 209/714

(Continued)

FOREIGN PATENT DOCUMENTS

FR 2597766 A1 10/1987

(Continued)

*Primary Examiner* — Terrell Matthews
(74) *Attorney, Agent, or Firm* — The Webb Law Firm

(57) ABSTRACT

Disclosed is a centrifugal separator with an inlet channel for a flow containing coarse and fine particles, a first outlet channel for a flow containing predominantly coarse particles, a second outlet channel for a flow containing predominantly fine particles and a separator chamber with at least one separator device, wherein the separator chamber connects the inlet channel to the first outlet channel and the second outlet channel, and wherein the inlet channel, the separator channel and the two outlet channels form a flow path. To improve the degree of efficiency, as a first separator device, one or more separator pockets are arranged in the separator chamber, which project into the flow path. Also disclosed is a corresponding method for the separation of a flow containing coarse and fine particles.

36 Claims, 3 Drawing Sheets

U.S. PATENT DOCUMENTS

| | | | | | |
|---|---|---|---|---|---|
| 2,329,900 | A | * | 9/1943 | Hermann | 209/139.1 |
| 2,741,366 | A | * | 4/1956 | Lykken | 209/139.2 |
| 3,181,637 | A | * | 5/1965 | Cockerell | 180/130 |
| 3,483,973 | A | * | 12/1969 | Heinz | 209/139.2 |
| 3,503,502 | A | * | 3/1970 | Donelson, Jr. | 209/139.1 |
| 3,520,407 | A | * | 7/1970 | Leschonski et al. | 209/139.2 |
| 3,615,008 | A | * | 10/1971 | Alpha | 209/139.2 |
| 3,770,124 | A | * | 11/1973 | Frangquist | 209/139.2 |
| 3,960,714 | A | * | 6/1976 | Strauss | 209/139.2 |
| 4,260,478 | A | * | 4/1981 | Hosokawa et al. | 209/139.2 |
| 4,296,864 | A | * | 10/1981 | Misaka et al. | 209/135 |
| 4,470,902 | A | * | 9/1984 | Yoshimori | 209/139.2 |
| 4,661,244 | A | * | 4/1987 | Hanke et al. | 209/139.2 |
| 4,693,811 | A | * | 9/1987 | Lohnherr | 209/139.2 |
| 4,792,393 | A | * | 12/1988 | Blasczyk et al. | 209/135 |
| 4,799,595 | A | * | 1/1989 | Binder | 209/135 |
| 4,818,376 | A | * | 4/1989 | Tanaka et al. | 209/135 |
| 4,869,786 | A | * | 9/1989 | Hanke | 209/139.2 |
| 4,935,123 | A | * | 6/1990 | Csillag et al. | 209/722 |
| 4,971,518 | A | * | 11/1990 | Florin | 415/121.2 |
| 5,032,222 | A | * | 7/1991 | Millioud | 159/4.1 |
| 5,055,182 | A | * | 10/1991 | Lohnherr | 209/148 |
| 5,120,431 | A | * | 6/1992 | Cordonnier | 209/135 |
| 5,165,549 | A | * | 11/1992 | Kanda et al. | 209/135 |
| 5,180,257 | A | * | 1/1993 | Narishima et al. | 406/173 |
| 5,279,466 | A | * | 1/1994 | Williams | 241/52 |
| 5,788,727 | A | * | 8/1998 | Barthelmess | 55/406 |
| 5,938,045 | A | * | 8/1999 | Makino et al. | 209/713 |
| 6,276,534 | B1 | * | 8/2001 | Huang et al. | 209/139.2 |
| 2006/0113225 | A1 | * | 6/2006 | Chang | 209/718 |

FOREIGN PATENT DOCUMENTS

| | | | |
|---|---|---|---|
| JP | 2000051723 | A | 2/2000 |
| JP | 2002233825 | A | 8/2002 |

* cited by examiner

CENTRIFUGAL SEPARATOR

BACKGROUND OF THE INVENTION

The invention relates to a centrifugal separator with an inlet channel for a flow containing coarse and fine particles, a first outlet channel for a flow containing predominantly coarse particles, a second outlet channel for a flow containing predominantly fine particles and a separator chamber with at least one separator device, wherein the separator chamber connects the inlet channel to the first outlet channel and the second outlet channel, and wherein the inlet channel, the separator chamber and the two outlet channels form a flow path.

The invention further relates to a method for the separation of a flow containing coarse and fine particles with such a centrifugal separator.

Centrifugal separators are devices with which coarse particles (coarse dust) are separated from fine particles (fine dust) in a flow, referred to as a two-phase flow. The particles occur, for example, in a mill for stone coal grinding by comminution of the grinding material and are then conducted to the separator by a carrier gas flow.

A distinction is made between centrifugal separators of static, dynamic, or static-dynamic type. All centrifugal separators have the factor in common that the flow entering by means of the carrier gas is conducted radially from the outside inwards through the separator and is provided with a twist. The separation between coarse and fine dust takes place in this context on the basis of the forces taking effect on the different particles, in particular centrifugal and gravitational forces.

The insufficiently ground coarse dust is screened out and conducted back to the grinding plates via a first outlet channel, which can have a coarse substance backflow cone element. The fine dust, which has been adequately ground is conveyed away via a second outlet channel, which can have one or more dust lines, for example to a burner of a combustion chamber.

Mills with centrifugal separators are known with which the gas flow, encumbered with grinding dust, enriched with buffer gases and vapours from the grinding process, enters the outer separator chamber with a twist applied by the arrangement of nozzles at the nozzle ring of the mill. A large part of the flow rises as far as the separator cover and impinges on it. In centrifugal movements the flow is then conducted to the inner separator chamber on the other side of a louver with fixed fins or blades and to a fin rotor rotating in the inner separator chamber.

In this situation, the louver formed from fixed fins, which traverse the flow path partially or wholly, serves as a separator device. Embodiments without louver fins are also known.

The rotating fin rotor represents a further separator device. The screened coarse dust then slips back between the fixed louver and rotor, via the coarse substance backflow cone element, onto the grinding plate.

A problem with the centrifugal separator described heretofore is that the flow between the inlet channel and the fin rotor still has a relatively high twist, and that, despite the two separator devices, a relatively large amount of coarse dust passes into the area on the other side of the fin rotor. This leads to the fin rotor being subjected to relatively high loadings and the degree of separation and sharpness of separation is reduced. The consequence is a reduced degree of efficiency of the known centrifugal separator.

To improve the degree of efficiency, the principle is known from the prior art, such as from JP 2000-051723 A, of arranging a deflector ring between the louver fins and the fin rotor, through which a part of the twisted flow is deflected. The intention is that the deflection and the resultant turbulences should increase the degree of separation of coarse dust and therefore the sharpness of separation.

Despite the arrangement of such a deflector ring in the separator chamber, the coarse particles, sinking down, continue to be subjected to a twist, are conducted back into the carrier gas flow, and then impose a burden on the rotor. Due to this, as before, a relatively high proportion of fine dust is carried along and conveyed back again, which imposes an additional burden on the internal grinding circuit. The increased milling circuit further leads to increased pressure losses of the system as a whole, which in turn exerts a negative effect on the smooth running of such a mill and its degree of efficiency. Moreover, the high loading of the rotor causes coarse dust to be carried out through the second outlet channel.

Taking the prior art described heretofore as a starting point, the present invention is based on the object of providing a centrifugal separator and a corresponding separation method with which the degree of efficiency is improved.

SUMMARY OF THE INVENTION

According to a first teaching of the present invention, the object as derived and described heretofore is resolved in that, as a first separator device, one or more separator pockets are arranged in the separator chamber, which project into the flow path.

Due to the fact that the separator pockets project into the flow path, and therefore to a certain degree block it, the twist of a part of the flow containing the coarse and fine particles is reduced, and this part of the flow is decelerated, wherein mainly coarse particles fall out of the flow due to the gravitational forces taking effect on them. These can then be conducted in a downwards movement to the grinding plate. Due to the reduction of the twist, therefore, on the one hand the separation sharpness is increased, since a separation takes place due to the effect of the gravitational forces on the coarse particles in the decelerated flow. On the other hand, at the same time the loads taking effect on the components of the separator are reduced.

In addition, due to the pockets projecting into the flow path a part of the particles are deflected in such a way that they traverse another part of the flow, preferably transversely. In this situation, the twist of the deflected particles is less than the twist of the traversing part flow, due to the separator pockets. It has been determined that, from the deflected and less twisted part flow, a large proportion of the fine particles still contained is carried along by the second more strongly twisted part flow flowing in transversely, such that the remaining downwards-moving particles are predominantly coarse particles. In this way the separation sharpness and degree of efficiency of the centrifugal separator are further increased.

According to one embodiment of the centrifugal separator according to the invention, use is made, as a second separator device, of a plurality of fixed fins, referred to as louver fins, which project into the flow path. As an alternative or in addition to this, as a third separator device a plurality of fins arranged on a rotor can be arranged in the separator chamber which project into the flow path. In this situation, the centrifugal separator is preferably a rotating separator, also referred to as a fin or plate separator, rotation separator, or dynamic separator, which in particular has a cylindrical separator chamber. In principle, however, the situation is also conceivable that use can be made as the separator of a static centrifugal separator, also referred to as a flap separator. In the latter case, no rotatable rotor is provided, but a plurality of concentrically arranged flaps. The best result in respect of separation sharpness is achieved, however, if provision is made as the second separator device for a ring of louver fins and a fin rotor as a further separator device.

The separator pockets, the louver fins and/or the rotor fins can be arranged in ring fashion, in particular concentrically, in the separator chamber, which leads to a particularly compact design of the separator.

In order to reduce the twist of a part of the flow, the separator pockets can be formed in a different manner. Preferably, the separator pockets in each case have a rear wall and at least one side wall. In this situation, the rear wall is arranged relative to the run of the flow path in such a way that, when the flow takes place through the separator chamber, the effect described occurs, according to which a first part flow of the flow is deflected and a second part flow of the flow flows at an angle, in particular at an angle of 90 degrees. The at least one side wall can also be arranged relative to the run of the flow path in such a way that, when the flow takes place through the separator chamber, the first part flow of the flow, after impinging on the first separator device, has a lesser twist than before impinging on the first separator device, wherein then, as mentioned heretofore, the twist of the deflected part flow is smaller than that of the crossing part flow.

According to a further embodiment of the centrifugal separator, one single separator pocket is provided, and the rear wall forms a guiding element which is concentric relative to the mid-axis of the separator chamber, and which projects into the flow path. One separator pocket represents the minimum in order for the desired twist reduction to take place. Preferably, however, a plurality of separator pockets are provided and the rear walls together form a guiding element concentric relative to the mid-axis of the separator chamber, which projects into the flow path.

Preferably, the guiding element, which can be arranged between the second and third separator device or between the louver fins and the fin rotor respectively, has the shape of a ring in a section transverse to the mid-axis of the separator chamber, which is enclosed at the periphery in particular. The term "ring" is not necessarily understood to mean a circular ring shape, but the guiding element may also have a rectangular shape in a section transverse to the mid-axis of the separator chamber.

It is usual, as is inherently known, for a separator cover, also designated a separator covering, to be provided which encloses the separator chamber in the axial direction, with the exception of an aperture opening into the second outlet channel. The guiding element is advantageously connected to the separator cover. In this way, the guiding element projects into the flow path, in particular if a twisted flow is used. Accordingly, from the outset the part of the flow with the coarse particles is decelerated and deflected, wherein the coarse particles are separated by the other part flow from any fine dust which may still be present.

Advantageously, the guiding element, which can run concentrically about the mid-axis of the in particular cylindrical separator chamber, is connected to a section of the fins of the second louver device, i.e. the louver fins. The section forms in particular at least a part of the side wall. Together with the separator cover, which preferably delimits the separator pockets in the axial direction, and with the section of the louver fins, the guiding element can then form the separator pockets.

In this situation, the separator cover forms the upper side of the separator pockets, the guiding element the rear side, and two adjacent fin pockets in each case form a side wall. Separator pockets formed in this way are, as has transpired, particularly well-suited to deflecting and decelerating a part flow. At the same time, the twisting of this part flow is reduced. The internal circuit of the mill is eased of its burden, since not so much fine dust passes back into the mill, and, at the same time, the load on the fin rotor of the centrifugal separator can be reduced.

The guiding element is advantageously arranged at an angle, in particular perpendicular, to the course of the flow path. In this situation, the course of the flow path is understood to mean directly before the impinging of the flow onto the separator pockets. In the case of a rotary separator, the flow at this point runs radially from the outside inwards.

According to a further embodiment, the centrifugal separator according to the invention can be adapted to different flow conditions, such as different particle sizes, different proportions of coarse and fine dust, different flow speeds, etc. To achieve this, the position inside the separator chamber of at least one of the separator pockets can be changed. The volume of at least one of the separator pockets can be changed. Preferably, the rear wall, the side wall, and/or the separator cover can be adjusted in an axial, radial, and/or circumferential direction, and/or in its angle.

According to a further embodiment of the centrifugal separator according to the invention, the first separator device, in particular the guiding element, traverses the flow path by 10 to 50%, preferably by 20 to 40%, and in particular 30%. In other words, depending on the flow conditions the first separator device or the guiding element blocks or closes the flow path at this point, and deflects a corresponding portion of the total flow and decelerates it. The other part of the flow path, i.e. at least 50%, preferably at least 60% and in particular 70%, is taken in by the other part of the flow, which crosses through the deflected part of the flow. The optimum with the separation of stone coals, which are only referred to here by way of example, has proved to be a traverse passage of about 30% of the flow path.

According to a further embodiment, the second separator device, in particular the louver fins, traverses the flow path completely, i.e. 100%. Accordingly, as an alternative or additionally, provision can also be made for the third separator device, in particular the fins of the rotor, to be able to cross the flow path likewise completely, i.e. 100%. In other words, in this case the fins run transverse to the flow direction in each case from one side to the opposite side of the flow path. Applications are entirely conceivable, however, in which the flow path is crossed by the fins and the rotor not completely but only partially.

Again, according to a further embodiment of the centrifugal separator according to the invention, the axis of rotation of the rotor runs co-axially to the mid-axis of the in particular cylindrical separator chamber. Preferably likewise co-axially to the mid-axis of the separator chamber and inside the louver rotor runs, preferably, the coal down pipe or another down pipe for conducting the material to be comminuted to a mill.

The centrifugal separator can also be an integral constituent of a mill with a grinding mechanism, or can be connected to the mill. With such a mill, which is in particular a vertical mill or a tube ball mill, and serves preferably for the milling of stone coals, hard brown coals, limestone, gypsum, and/or cement clinker, with simple means by separator pockets, which allow for a crossing of two part flows and a twist reduction of a part flow, a clear increase in separation sharpness is achieved and the burden on the internal mill circuit is eased.

According to a further embodiment, the first outlet channel has a coarse substance backflow cone element, which leads to the grinding mechanism of the mill. Advantageously, the coarse substance backflow cone is likewise arranged concentrically about the mid-axis of the separator chamber or its extension. In this way, in particular if the down pipe runs inside the louver rotor and inside the coarse substance backflow cone, a compact design of the centrifugal separator is achieved.

According to a further embodiment of the present invention, the second outlet channel has at least one dust line, which leads, for example, to a burner. Provision may also be made for a plurality of dust lines.

Finally, according to a further teaching of the present invention, the object is resolved with a method of the type referred to in the preamble, with the use of the centrifugal separator described heretofore, in that a first part flow of the flow, which advantageously is subjected to a twist before impinging on the first separator device, is deflected at separator pockets of a first separator device, and a second part flow of the flow flows at an angle, in particular transverse. As a result of this method, as has been described in detail heretofore, the degree of efficiency of a centrifugal separator is perceptibly improved by increasing the separation sharpness. The burden on the internal mill circuit is also eased, and the loads taking effect on the centrifugal separator are reduced.

In particular, the twist is produced by introducing a twisted carrier gas flow. This can be achieved in that the nozzles on the nozzle ring of the mill are set in a specific direction and at a specific angle relative to the mid-axis of the nozzle ring. Thanks to the separator pockets, advantageously the situation can be reached that the first part flow of the flow, after impinging on the first separator device, has a lesser twist than before impinging on the first separator device.

According to a further embodiment of the method according to the invention, the centrifugal separator is operated at over-pressure. The centrifugal separator according to the invention can, however, as an alternative, also be operated at under-pressure. Both are possible by means of the design according to the invention of the centrifugal separator, and equally lead to a clear improvement of the separation sharpness when separating a flow containing coarse and fine particles, which in particular is a two-phase flow.

There are now a large number of possibilities of designing and further developing the centrifugal separator according to the invention, the mill according to the invention, and the method according to the invention.

BRIEF DESCRIPTION OF THE DRAWINGS

To this end, the invention is explained in greater detail hereinafter on the basis of drawings representing only preferred embodiments. The drawings show.

DETAILED DESCRIPTION OF THE INVENTION

Figure 1:
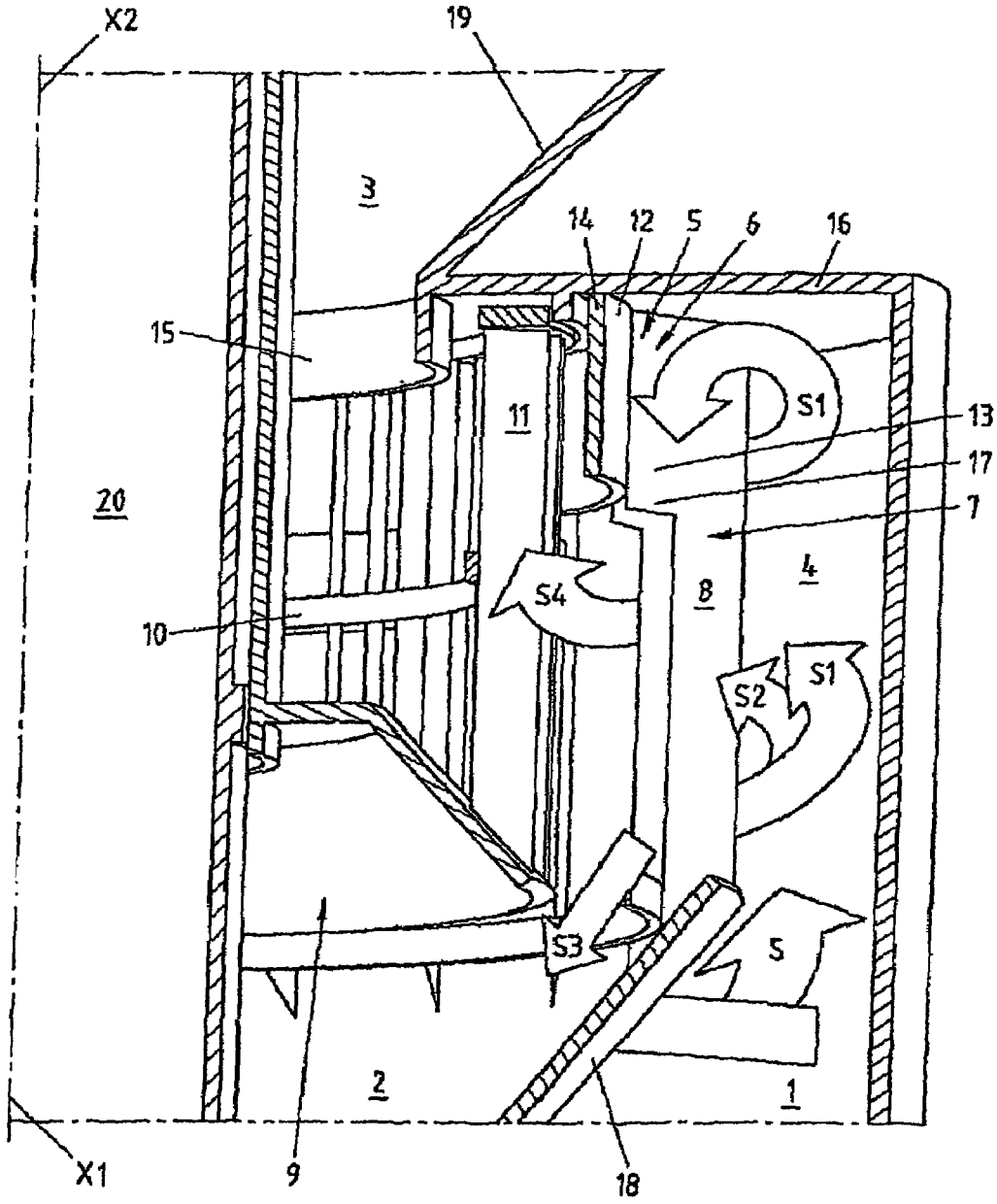
FIG. 1 A principal representation of a partially exposed centrifugal separator according to an embodiment of the present invention, FIG. 2 A section in the longitudinal direction of the centrifugal separator from FIG. 1, and FIG. 3 A section in the transverse direction of the centrifugal separator from FIG. 1.

The principle representation in FIG. 1 shows a centrifugal separator in the form of a rotary separator according to an embodiment of the present invention, which has an inlet channel 1 for a two-phase flow S containing coarse and fine particles, represented here by arrows. Provision is further made for a first outlet channel 2 for a flow containing predominantly coarse particles, and a second outlet channel 3 for a flow containing predominantly fine particles.

The division into the flow containing coarse particles and the flow containing fine particles takes place in a separator chamber 4 with three separate separator devices 5, 7 and 9. The separator chamber 4 connects the inlet channel 1 with the first outlet channel 2 and the second outlet channel 3. It can further be seen that the separator chamber 4 is cylindrical in design and, as soon as the flow S which is to be separated has risen from a mill (not shown) through the intake channel 1 under the imposition of twist, throughflow takes place radially from outside to the inside. In this situation the intake channel 1, the separator chamber 4, and the two outlet channels 2 and 3, form a flow path through the centrifugal separator.

As a first separator device 5, a plurality of separator pockets 6 are arranged in the separator chamber 4, which project into the flow path. As a result of the separator pockets 6, a first part flow S1 of the flow S in the upper part of the separator chamber 4 is deflected close to the separator cover 16, wherein the twist of the part flow S1 is reduced. In addition, the remaining part flow S2 of the flow S flows radially into the interior of the centrifugal separator, wherein it crosses the deflected flow S1. Due to the reduction of the twist, the first part flow is so sharply decelerated that coarse particles fall out of the flow and are conducted back to the grinding mechanism of the mill via the coarse substance backflow cone element. The coarse particles of the first part flow S1 which fall out are in this situation flowed through by the crossing part flow S2, wherein residual fine dust is carried along with them. In this way, the proportion of fine dust which is conducted back to the grinding mechanism with the coarse particles is reduced to a minimum, which eases the burden on the internal circuit of the mill.

At the same time, the part flow S2 is guided through the louver fins 8 of the second separation device 7 and the fins 11 of the rotor 10 of the third separator device 9. In this situation, in the first instance a separation of the part flow S2 is carried out by means of the louver fins 8, and then a further separation by means of the fins 11, wherein separated coarse particles are likewise conducted through the first outlet channel 2 and the coarse substance backflow cone element 18 to the grinding system once again.

The remaining part of the flow S, which has an adequately high proportion of fine dust, is conducted through the aperture 15 into the second outlet channel 3 and from there into a dust line 19, which in the embodiment shown runs to a burner (not shown).

The separator pockets 6, in the embodiment represented here, by way of example, are formed and arranged as follows.

First, the separator pockets 6 in each case have a rear wall 12 and at least one side wall 13. The separator pockets 6 are delimited upwards by the underside of the separator cover 16. Together, the rear walls 12 of the separator pockets 6 form a concentric guiding element 14, concentric to the mid-axis X1 of the separator chamber 4, which projects into the flow path. In this situation, the guiding element 14 and each rear wall 12 respectively are arranged relative to the run of the flow path in such a way that, when the flow passes through the separator chamber 4, a first part flow S1 is deflected, as described heretofore, in such a way that a second part flow S2 flows transverse to it. At the same time, the side walls 13, which in each case are formed by a section 17 of the louver fins 8 of the second separator device 7, arranged relative to the run of the flow path in such a way that, when the flow passes through the separator chamber 4, the first part flow S1, after impinging on the separator pockets 6, has a lesser twist than before impinging. After impinging, the twist of the first part flow S1 is also perceptibly reduced in relation to the second part flow S2.

The guiding element 14 and the separator pockets 6, in a section transverse to the mid-axis X1 of the separator chamber 4, have the form of a circumferentially enclosed circular ring. This can also be seen in particular from FIG. 3, which is described in greater detail hereinafter.

FIG. 1 also shows that the guiding element 14 is arranged perpendicular to the run of the flow path, i.e. the flow path immediately before entering the separator pockets 6. The guiding element 14 is connected to the separator cover 16 and runs from the separator cover 16 in the direction of the first outlet channel 2. The guiding element 14 extends so far into the flow path that it crosses this by about 30%, and thereby closes it by 30%. The guiding element 14 is arranged at a position, namely between the fins 11 of the rotor 10 and the fins 8 of the fin louver, and at the same time above the aperture formed as the coarse substance backflow cone element 18 of the first outlet channel 2, such that the coarse particles extracted from the first part flow S1 by means of the separator pockets 6 can fall into the said coarse substance backflow cone element 18.

By contrast with the guiding element 14, the louver fins 8 and the rotor fins 11 traverse the flow path entirely, i.e. 100%.

Figure 2:
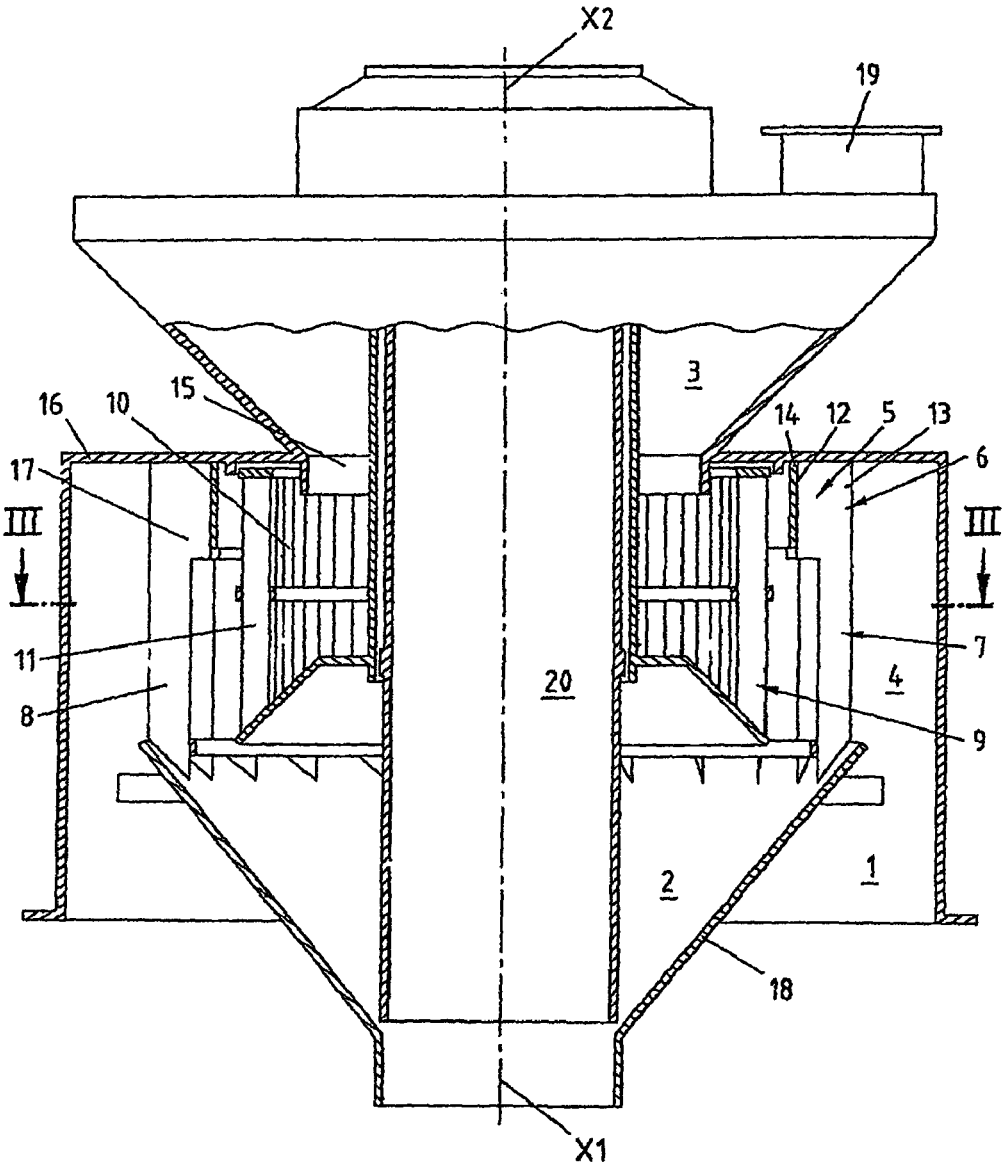

FIG. 2 shows finally a sectional view of the centrifugal separator described heretofore on the basis of FIG. 1.

The sectional view shows clearly, in addition to the inlet channel 1, the separator channel 4, and the outlet channels 2 and 3, the central down pipe 20, in which the coal, in this case stone coal, is conducted to the grinding mechanism. Arranged concentrically around this down pipe 20 are the other components and this which leads to an especially compact design of the centrifugal separator and the mill.

FIG. 3 again shows clearly the concentric arrangement of the individual components of the rotary separator, in a section transverse to the longitudinal axis of the separator. In this separator a twisted flow S, which has risen in the axial direction into the separation chamber 4, flows radially from the outside inwards through the individual separator devices 5, 7, and 9. In other words, the flow S flows from the outer part of the separator chamber 4 partially in front of and into the separator pockets 6, as a result of which a first part flow S1 with reduced twist is produced, which is deflected axially downwards, while by contrast a second part flow S2 is conducted through the fixed louver fins 8, and in this situation the part flow S1, and in particular the particles in it, cross and carry along the fine dust contained in it. The particles separated out during the passing and traversing of the individual separator devices are again conducted axially downwards in a flow S3 by the coarse substance backflow cone element 18, in order once again to be comminuted by the grinding mechanism of the mill.

A part flow S4 is formed from the part flow S2 and the fine dust carried with it, which is conducted into the rotor 10 provided with fins 11 in the inner part of the separator chamber 4, wherein here a further separation takes place. The fine dust which remains after the individual separation stages is finally conducted through an aperture in the separator cover 16 axially upwards into the second outlet channel 3 and via a dust line 19 to a burner (not shown).

Finally, in the interior of the separator, the down pipe 20 is also shown, arranged around which are the separator devices 5, 7, and 9, concentrically and circularly.

Figure 3:
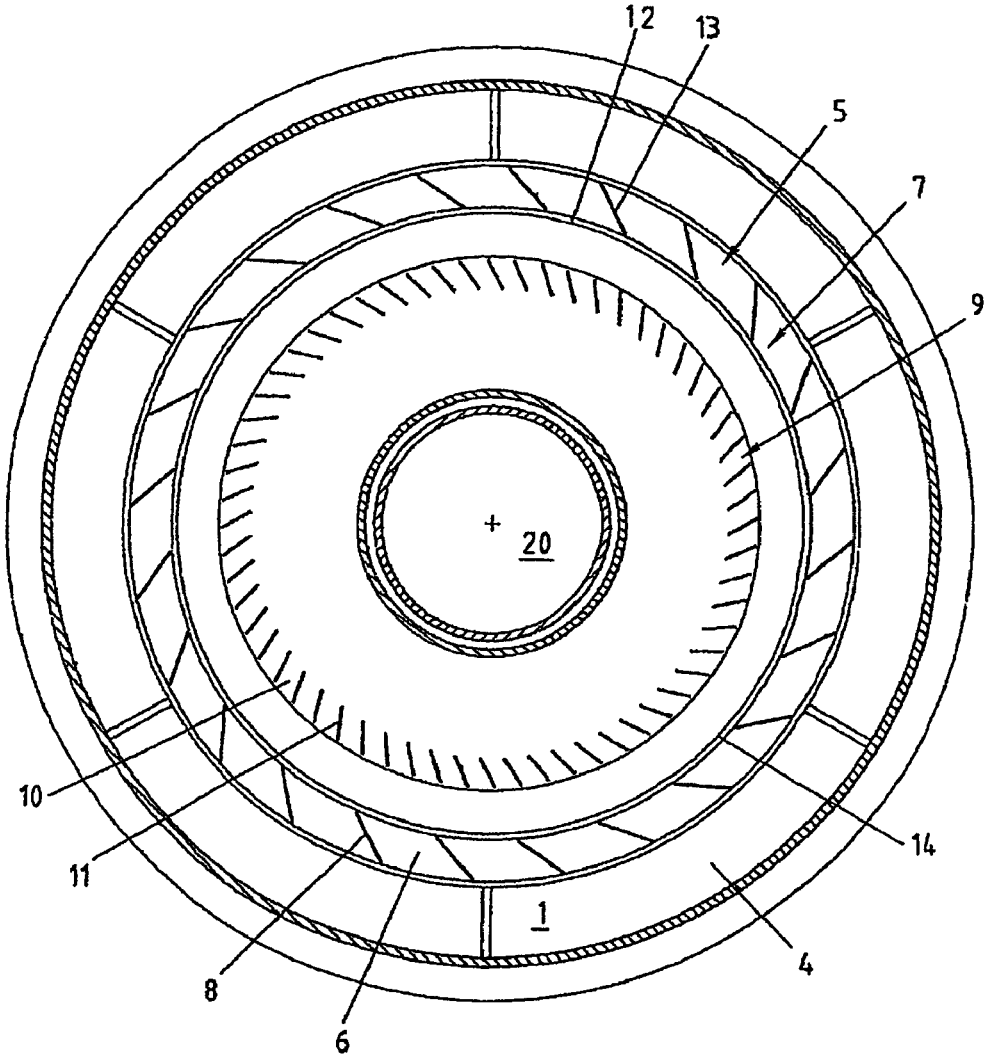

The centrifugal separator represented by way of example in FIGS. 1 to 3 further has the advantage that a separation is already carried out before the flow runs through the fins 8 and 11, by means of which a large portion of coarse particles is removed from the flow and conducted back to the grinding mechanism. In this way, the separation sharpness can be perceptibly increased, the burden on the internal mill circuit eased and the degree of efficiency of the centrifugal separator and of the mill is increased. Loads which have an effect on the components of the centrifugal separator due to the flow containing particles, in particular on the fins, are also reduced to a minimum.

The invention claimed is:

1. A centrifugal separator comprising:

(a) an inlet channel for a flow S containing coarse and fine particles, (b) a first outlet channel for a flow containing predominantly coarse particles, (c) a second outlet channel for a flow containing predominantly fine particles, and (d) a separator chamber with at least one separator device, wherein the separator chamber connects the inlet channel to the first outlet channel and to the second outlet channel, and wherein the inlet channel, the separator chamber, and the two outlet channels form a flow path, wherein, as a first separator device, one or more separator pockets each comprising a rear wall and at least one side wall are arranged in the separator chamber, which project into the flow path and wherein due to the separator pockets a first part flow S1 of the flow S is deflected and decelerated, wherein the twist of the first part flow S1 is reduced, causing the coarse particles to fall out of the flow and a remaining part flow S2 to flow radially into the interior of the centrifugal separator such that the flow S2 crosses the deflected flow S1.

2. The centrifugal separator according to claim 1, wherein, as a second separator device, a plurality of fixed fins or plates are arranged in the separator chamber, which project into the flow path.

3. The centrifugal separator according to claim 2, wherein, as a third separator device, a plurality of fins or plates are arranged on a rotor in the separator chamber, which project into the flow path.

4. The centrifugal separator according to claim 3, wherein the separator pockets, the fins or plates in the separator chamber, and/or the fins or plates on the rotor are arranged in ring fashion, in particular concentrically, in the separator chamber.

5. The centrifugal separator according to claim 1, wherein the separator pockets in each case have a rear wall and at least one side wall.

6. The centrifugal separator according to claim 5, wherein the rear wall is arranged relative to the course of the flow path in such a way that, when the flow passes through the separator chamber, a first part flow of the flow is deflected and a second part flow flows to the flow at an angle.

7. The centrifugal separator according to claim 5, wherein the at least one side wall is arranged relative to the run of the flow path in such a way that, when the flow passes through the separator chamber, the first part flow of the flow, after impinging on the first separator device, has a lesser twist than before impinging on the first separator device.

8. The centrifugal separator according to claim 5, wherein at least one single separator pocket is provided and the rear wall forms a concentric guiding element relative to the mid-axis of the separator chamber, which projects into the flow path.

9. The centrifugal separator according to claim 5, wherein a plurality of separator pockets are provided and the rear walls, together form a guiding element concentric relative to the mid-axis of the separator chamber, which projects into the flow path.

10. The centrifugal separator according to claim 8, wherein the guiding element has, in a section transverse to the mid-axis of the separator chamber, the shape of a ring, which in particular is enclosed on its circumference.

11. The centrifugal separator according to claim 10, wherein the guiding element has, in a section transverse to the mid-axis of the separator chamber, a rectangular shape.

12. The centrifugal separator according to claim 8, wherein the guiding element is arranged between the second separator device and the third separator device.

13. The centrifugal separator according to claim 1, wherein a separator cover is provided closing the separator chamber in the axial direction with the exception of an aperture opening into the second outlet channel.

14. The centrifugal separator according to claim 13, wherein the guiding element is connected to the separator cover.

15. The centrifugal separator according to claim 8, wherein the guiding element is connected to a section of the fins or plates of the second separator device.

16. The centrifugal separator according to claim 15, wherein the section of the fins forms at least a part of the side wall of the separator pockets.

17. The centrifugal separator according to claim 13, wherein the separator cover delimits the separator pockets in the axial direction.

18. The centrifugal separator according to claim 1, wherein the position inside the separator chamber of at least one of the separator pockets can be changed.

19. The centrifugal separator according to claim 1, wherein the volume of at least one of the separator pockets can be changed.

20. The centrifugal separator according to claim 5, wherein the rear wall, the side wall, and/or the separator cover can be adjusted in the axial, radial and/or circumferential direction and/or in the angle.

21. The centrifugal separator according to claim 8, wherein the guiding element is arranged at an angle, in particular perpendicular, to the course of the flow path.

22. The centrifugal separator according to claim 1, wherein the first separator device, in particular the guiding element traverses the flow path by 10 to 50%, preferably 20 to 40% and in particular by 30%.

23. The centrifugal separator according to claim 2, wherein the second separator device, in particular the fins or plates, traverse the flow path entirely.

24. The centrifugal separator according to claim 3, wherein the third separator device, in particular the fins or plates, traverse the flow path entirely.

25. The centrifugal separator according to claim 3, wherein the axis of rotation of the rotor runs coaxially to the mid-axis of the separator chamber.

26. The centrifugal separator according to claim 1, wherein the centrifugal separator is a rotary separator.

27. The centrifugal separator according to claim 1, wherein the centrifugal separator is an integral constituent part of a mill with a grinding mechanism or can be connected to the mill.

28. The centrifugal separator according to claim 27, wherein the mill is a vertical mill or a tubular ball mill.

29. The centrifugal separator according to claim 27, wherein the mill is a mill for the comminution of stone coal, hard brown coal, limestone, gypsum and/or cement clinker.

30. The centrifugal separator according to claim 27, wherein the first outlet channel has a coarse substance back-flow cone element, which leads to the grinding mechanism of the mill.

31. The centrifugal separator according to claim 1, wherein the second outlet channel has at least one dust line, which is configured to lead to a burner of a combustion chamber.

32. A method for the separation of a flow containing coarse and fine particles, making use of a centrifugal separator according to claim 1 wherein a first part flow of the flow is deflected to separator pockets of a first separator device and a second part flow flows at an angle to the flow.

33. The method according to claim 32, wherein the flow containing the coarse and fine particles is a two-phase flow.

34. The method according to claim 32, wherein the flow is subjected to a twist before impinging on the first separator device.

35. The method according to claim 34, wherein the first part flow of the flow, after impinging on the first separator device, has a lesser twist than before impinging on the first separator device.

36. The method according to claim 32, wherein the centrifugal separator is operated above or below atmospheric pressure.

* * * * *